US009920649B2

(12) United States Patent
Tecza et al.

(10) Patent No.: US 9,920,649 B2
(45) Date of Patent: Mar. 20, 2018

(54) VALVE SEQUENCING SYSTEM AND METHOD FOR CONTROLLING TURBOMACHINE ACOUSTIC SIGNATURE

(71) Applicants: Joseph Andrew Tecza, Scio, NY (US); Stephen Samuel Rashid, Wellsville, NY (US)

(72) Inventors: Joseph Andrew Tecza, Scio, NY (US); Stephen Samuel Rashid, Wellsville, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 0 days.

(21) Appl. No.: 14/597,333

(22) Filed: Jan. 15, 2015

(65) Prior Publication Data

US 2015/0125261 A1 May 7, 2015

Related U.S. Application Data

(63) Continuation of application No. 12/609,997, filed on Oct. 30, 2009, now abandoned.

(51) Int. Cl.
*F01D 17/14* (2006.01)
*F01D 17/18* (2006.01)

(52) U.S. Cl.
CPC ..... *F01D 17/145* (2013.01); *F01D 17/18* (2013.01); *F05D 2260/96* (2013.01); *F05D 2270/3061* (2013.01); *F05D 2270/331* (2013.01); *F05D 2270/333* (2013.01)

(58) Field of Classification Search
CPC ..... F01D 17/10; F01D 17/145; F01D 17/18; F01D 2270/3061; F01D 2270/331; F01D 2270/333; F05D 2260/96; F05D 2260/964
USPC ..... 415/1, 51, 118, 119, 154.1, 154.3, 155
See application file for complete search history.

(56) References Cited

U.S. PATENT DOCUMENTS

| | | | | |
|---|---|---|---|---|
| 3,561,216 | A * | 2/1971 | Moore, Jr. | F01D 17/18 415/14 |
| 4,325,670 | A * | 4/1982 | Silvestri, Jr. | 415/1 |
| 4,604,028 | A * | 8/1986 | Yeaple et al. | 415/38 |
| 4,847,039 | A * | 7/1989 | Kendall | F01D 17/18 376/297 |
| 4,940,383 | A * | 7/1990 | Silvestri, Jr. | 415/44 |
| 8,061,961 | B2 * | 11/2011 | Liu | F01D 9/02 415/1 |
| 2007/0156363 | A1 * | 7/2007 | Stewart et al. | 702/113 |

* cited by examiner

*Primary Examiner* — Jason Shanske
*Assistant Examiner* — Jesse Prager

(57) ABSTRACT

A system and method for controlling the acoustic signature of a turbomachine having a plurality of valves wherein an operating load is identified and an arc of admission across a plurality of nozzles is associated therewith. A valve sequencing scheme is selected and implemented to activate the arc of admission for a particular operating load so as to minimize valve noise by adjusting valves simultaneously rather than consecutively.

13 Claims, 6 Drawing Sheets

VALVE SEQUENCING SYSTEM AND METHOD FOR CONTROLLING TURBOMACHINE ACOUSTIC SIGNATURE

CROSS-REFERENCE TO RELATED APPLICATIONS

This patent application is a continuation of co-pending U.S. patent application Ser. No. 12/609,997, which was filed on Oct. 30, 2009, the disclosure of which is incorporated herein by reference to the extent consistent with the present application.

FIELD OF THE INVENTION

The present invention relates to turbomachines, and more particularly to reducing a turbomachine's acoustic signature.

BACKGROUND

Turbomachines may produce noise from several fluid dynamic sources, including wake cutting, high velocity fluid dynamics, and turbulent flow fields. These noise sources may represent fluid energy that is not directed into the shaft of a turbomachine. The turbomachine's efficiency may be increased by transferring more fluid energy to the shaft. Valve sequencing is one method of transferring more fluid energy to the shaft.

Valve sequencing may also affect the acoustic signature of a turbomachine. In some instances, modifying valve sequencing for efficiency gains may increase the acoustic signature of a turbomachine. Thus, there is a need for a valve sequencing system for controlling a turbomachine's acoustic signature.

SUMMARY

Embodiments of the present disclosure may provide a method of controlling a turbomachine having a plurality of valves, the method including selecting a desired operating load for the turbomachine, and identifying at least one arc of admission, wherein each of the plurality of valves is either completely closed or completely open when the arc of admission is achieved. Further, the method includes constructing a valve sequencing scheme configured to activate the identified arc of admission so as to minimize an acoustic signature of said plurality of valves during implementation of the desired operating load.

Embodiments of the present disclosure may further provide a turbomachine process control mechanism configured to implement a valve sequencing scheme to control a plurality of valves. The turbomachine process control mechanism includes a control system that is adapted to select a desired operating load for the turbomachine, and identify at least one arc of admission to achieve the desired operating load. In addition, the control system is further adapted to construct a valve sequencing scheme configured to activate the identified arc of admission so as to minimize an acoustic signature of said plurality of valves during implementation of the desired operating load.

Embodiments of the present disclosure may further provide a turbomachine, that includes a plurality of valves, and a turbomachine process control mechanism configured to implement a valve sequencing scheme to control the plurality of valves. The turbomachine process control mechanism includes a control system adapted to select a desired operating load for the turbomachine, and identify at least one arc of admission to achieve the desired operating load. The control system is further adapted to construct a valve sequencing scheme configured to activate the identified arc of admission so as to minimize an acoustic signature of said plurality of valves during implementation of the desired operating load.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
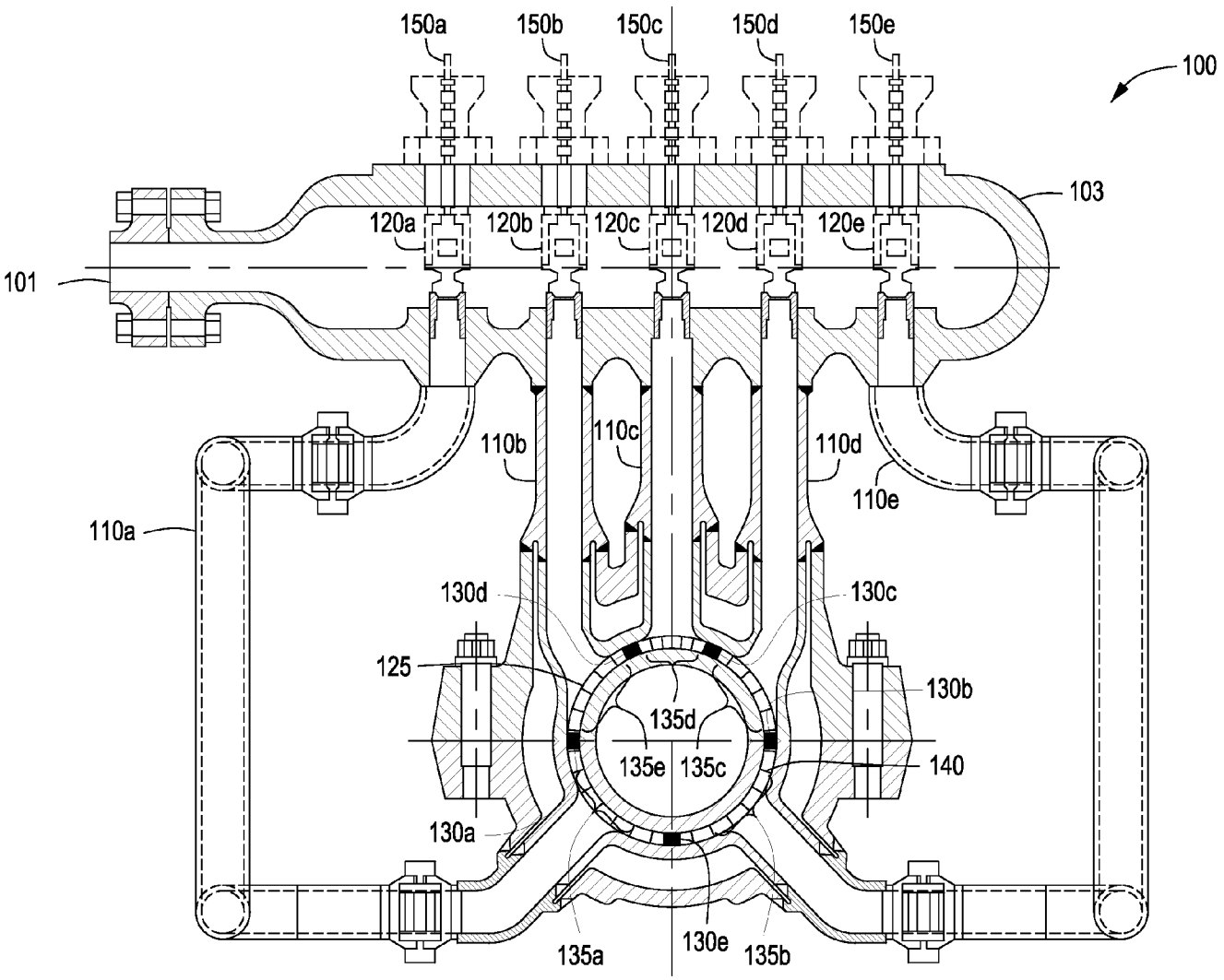
FIG. 1 illustrates a partial cross-sectional view of an exemplary valve system of a turbomachine according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from an exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

FIG. 1 is a partial cross-sectional view of an exemplary turbomachine 100. The turbomachine 100 is a multistage steam turbine. However, in other embodiments, the turbomachine 100 may be any other type of turbine or expander. The turbomachine 100 includes an inlet pipe 101, a steam chest 103, and pipes 110*a-e*. One end of each of the pipes 110*a-e* is coupled to a valve 120*a-e*, respectively, and the other end of each of the pipes 110*a-e* fluidically communicates with a diaphragm 125 that includes a plurality of partitions 130*a-e* that separate portions of the diaphragm 125. The diaphragm 125 is segmented into a plurality of nozzle bowls 135*a-e* that are separated by the partitions 130*a-e*. Each of the nozzle bowls 135*a-e* includes a plurality of nozzles 140, which may also be known as diaphragm segments. The pipes 110*a-e* are configured to facilitate the flow of process gas to the nozzle bowls 135*a-e*. In an exemplary embodiment, the process gas includes steam, but in other embodiments may include air, products of combustion, carbon dioxide, or a process fluid.

The diaphragm 125 may include noise-reducing technology, which can include noise-reduction arrays. For example, the noise-reduction arrays may include resonator arrays. Additionally, or alternatively, noise-reduction arrays may be located proximal to the diaphragm 125. Exemplary embodiments of noise-reduction arrays include the technology described in U.S. Pat. Nos. 6,550,574; 6,601,672; 6,669,436; and 6,918,740.

The nozzle bowls 135*a-e* are configured to define one or more arcs of admission, or locations about the circumference of the diaphragm 125 where process gas may be received due to a particular configuration of one or more of the open valves 120*a-e*. An arc of admission describes a set of adjacently-disposed nozzles 140, such as the resonator arrays discussed above, configured to receive the process gas from one or more supply pipes 110*a-e*. Because there are multiple arcs of admission defined by the nozzle bowls 125*a-e*, there are multiple combinations of nozzles 140 that could receive process gas at any one time. Each combination can be associated with a particular setting of valves 120. As such a particular arc of admission can be defined by a particular combination of open and closed valves 120. For example, a first arc of admission may include opening the valves 120*a-c* and closing the valves 120*d-e*, so that the nozzle bowls 135*a*, 135*d*, and 135*e* will receive the process gas, and nozzle bowls 135*b* and 135*c* will not receive the process gas. Partitions 130*a-e* prevent process gas from being transferred between the nozzle bowls 135*a-e*.

Each valve 120*a-e* is coupled to a lifting mechanism 150*a-e*, respectively. Each lifting mechanism 150 may include a cam coupled to a rod. In another exemplary embodiment, the lifting mechanism 150 may include an electromechanical actuator. In various other exemplary embodiments, the lifting mechanism 150 may be any type of linear actuator. Any combination of the foregoing may constitute a valve assembly. Other valve assemblies may include any device or mechanism configured to control the flow of a process gas to the nozzle bowls 135*a-e*.

In exemplary operation, the lifting mechanisms 150 lift the respective valves 120 to an open position. When any one of the valves 120 is open, it allows process gas to flow to the pipe 110*a-e* that is coupled to the respective valve 120. The process gas then flows to the respective nozzle bowls 135*a-e* that are fluidically coupled to the open valves 120, and across the nozzles 140 thereof.

Figure 2:
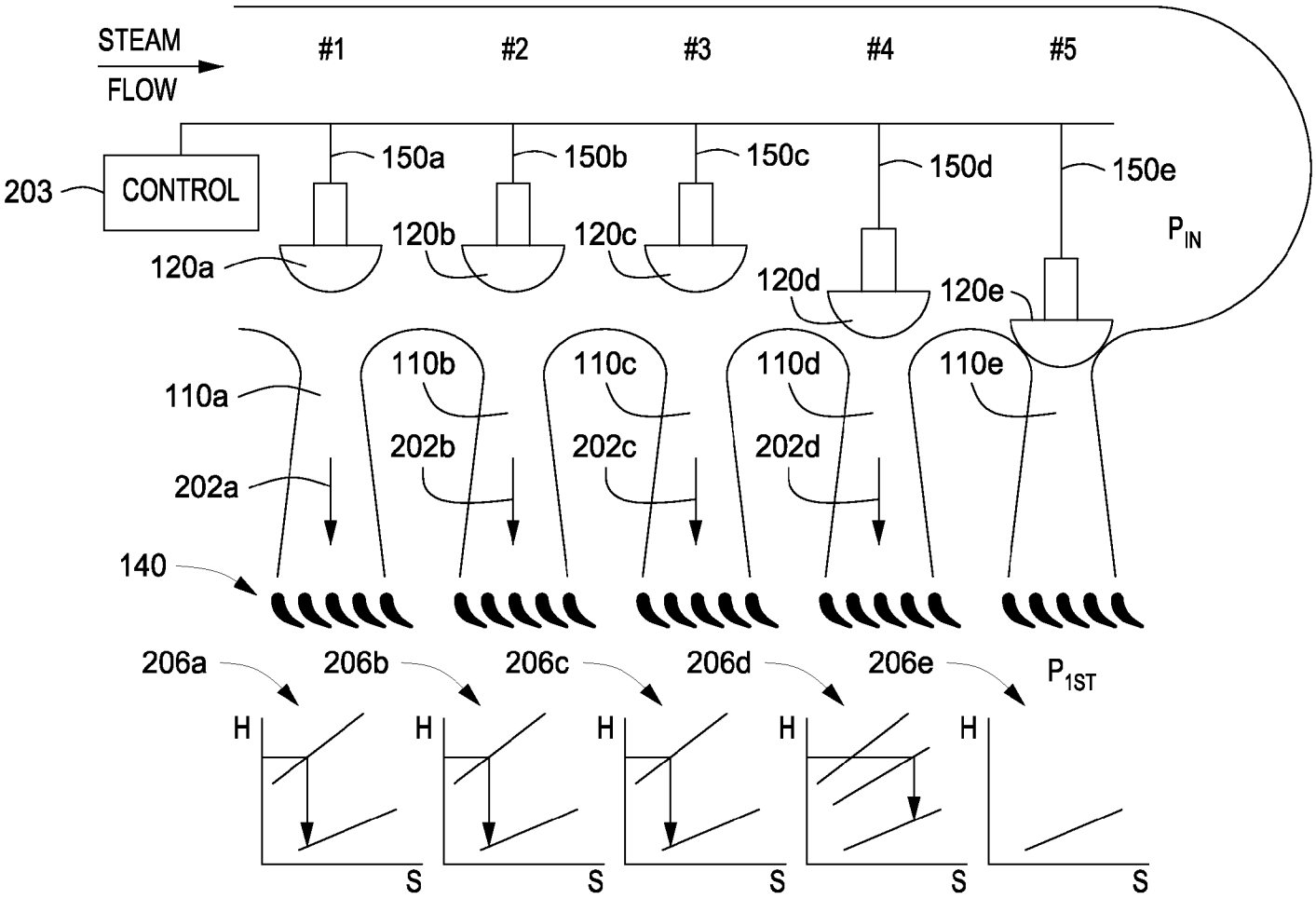
FIG. 2 illustrates a diagrammatic view of an exemplary valve system of a turbomachine according to one or more aspects of the present disclosure.

Referring now to FIG. 2, the valves 120 and the pipes 110*a-e* are shown. Arrows 202*a-d* illustrate the direction of process gas moving through the pipes 110*a-d*. FIG. 2 also shows a simplified view of the nozzles 140.

According to an exemplary embodiment of the present disclosure, a valve sequencing scheme may be used to attenuate valve noise based on the timing of acoustic-sensitive events. An acoustic-sensitive event may include one or more transition events, such as transitioning the turbomachine 100 from a first operating load to a second operating load, where each operating load includes separate power and/or process gas flow rate requirements. During these transition events, the valves 120*a-e* must be manipulated to accommodate a new flow rate and may produce undesirable noise. Upon identifying one or more transition events, a valve sequencing scheme may be implemented to attenuate any resultant turbomachine 100 noise. For example, the valve sequencing system may be configured to time the opening and closing of the valves 120*a-e* so that one or more transition events occur before the next valve 120*a-e* in a sequence begins to open. As such, valve sequencing provides for successive valve 120 openings and closings so that a particular arc of admission is achieved at various times (for various power requirements) during the operation of the turbomachine 100.

As shown in FIG. 2, the lifting mechanisms 150 are communicably coupled to a control system 203. A control system 203 includes a microprocessor device configured to receive inputs and generate outputs in accordance with predetermined algorithms or instructions. In other embodiments, the control system 203 may be any computer-based system utilized for regulating the operation of valves 120. The control system 203 implements the valve sequencing scheme based on predetermined acoustic requirements by controlling the movement of the lifting mechanisms 150. The control system 203 increases operational flexibility with respect to selecting an appropriate arc of admission so as to attenuate valve noise during a particular operational mode, because it allows the valves 120 to be controlled in accordance with a valve sequencing scheme, program, or other algorithm.

A valve 120 that is positioned at a completely open position (e.g., leaving the entrance to a pipe 110 substantially unobstructed) is said to be operating at a "valve point." For example, in FIG. 2, valves 120*a-c* are shown at a valve point. In contrast, valve 120 may be positioned at a completely "closed position." When a valve 120 is positioned at a completely "closed position," then corresponding pipe 110 receives no, or substantially no, gas flow. For example, in FIG. 2, the valve 120*e* substantially obstructs the pipe 110*e* such that no, or substantially no, gas flows past the valve 120*e* and into the pipe 110*e*.

When a valve 120 is neither completely closed nor completely open, it may be said to be operating at a "throttling position," as illustrated in FIG. 2 by valve 120*d*. When one of the valves 120 is positioned at a throttling position, the turbomachine 100 experiences a large pressure drop, high Mach number flow, and/or turbulence caused by process gas flowing around a valve 120. Such conditions may cause the turbomachine 100 to operate inefficiently. When none of the valves 120 is operating at a throttling position, the turbomachine 100 may be said to be operating at an "even valve point."

Each valve produces an acoustic signature when gas flows therethrough. When a valve 120 is positioned at a throttling position, it generates a larger acoustic signature than when the valve 120 is operating at either a valve point or a closed position. The acoustic signature of the valves 120 operating in a throttling position is referred to as "valve screech" or "valve noise." The acoustic signature of the valves 120 are a component of the acoustic signature of the turbomachine 100. To improve the performance of the turbomachine 100, and reduce valve noise, the operation sequence of the valves 120 may be configured to minimize the time that one or more of the valves 120 are operating at a throttling position. In addition to improving the efficiency of the turbomachine 100, minimizing the time that one or more of the valves 120 operates at a throttling position also has the added benefit of reducing valve noise during turbomachine 100 operation.

In an embodiment, two or more valves 120 may be moved simultaneously, rather than moving the valves 120 individually. For example, if the valves 120 are moved simultaneously from a completely closed position to a completely open position, or vice-versa, then the total amount of time that the valves spend at a throttling position is decreased as compared to consecutively moving each valve 120 one after the other. This also has the benefit of reducing the total amount of time that valve noise is produced.

Graphs 206*a-e* show a simplified relationship between entropy and enthalpy in the process gas flowing through each valve 120, and further illustrate the gains in efficiency achieved by minimizing throttling. The graphs 206*a-c* illustrate the entropy and enthalpy (i.e., energy) changes experienced in a process gas flow through the valves 120*a-c*, which are in the completely open position. As will be appreciated, the two lines in graphs 206*a-c* each indicate the inlet and exit pressure in the valve and nozzle bowl combination. Accordingly, as illustrated by the arrows, the process gas enters the valves 120*a-c* at a given, higher pressure. It then proceeds to the nozzle bowls 135*a-e*, where a portion of the potential energy stored in the flow as pressure is transferred into rotational mechanical energy, with a commensurate pressure drop experienced in the gas flow. In contrast, the valve 120*d* is only partially open. The graph 206*d* shows that the steam flow experiences two pressure drops: first, when flowing through the partially obstructed valve 120*d*, and second when transferring energy to the nozzles 140. This first pressure drop represents wasted potential energy that is dissipated in several forms, including valve noise. This increased valve noise represents loss of energy to the surroundings, and also an increase in a turbomachine's 100 acoustic signature.

Based on the foregoing, it can be seen that process gas passes through the valves 120*a-c* with minimal loss. In contrast, valve 120*d* experiences a comparatively greater throttling loss, will be noisier, and will require a higher process gas flow to achieve the same power output. The valve 120*e* is completely closed, so there is no flow and no loss.

Figure 3:
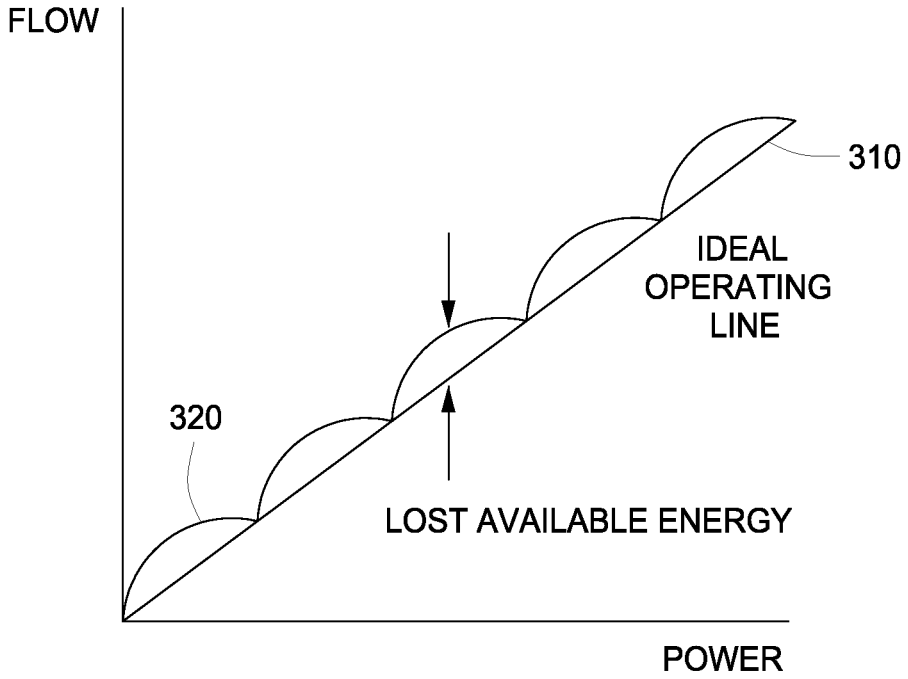
FIG. 3 illustrates a graph of exemplary operating conditions of a turbomachine according to one or more aspects of the present disclosure.

FIG. 3 is a graph of process gas flow rate (y-axis) versus output power (x-axis) during an exemplary operation of the turbomachine 100. An ideal operating line 310 represents ideal operating points. That is, the turbomachine 100 that is operating at a point on the ideal operating line 310 transforms the maximum amount of potential energy from the flow of process gas to power, with no potential energy lost to throttling. Such conditions are more likely to occur when all of the valves 120 are operating at an even valve point. As explained above, energy is lost when one or more of the valves 120 are operating at a throttling position. Under real-world operating conditions, the turbomachine 100 is more likely to operate at some point along the line 320. The delta between the ideal operating line 310 and the line 320 represents available energy that may be lost due to throttling.

Figure 4A:
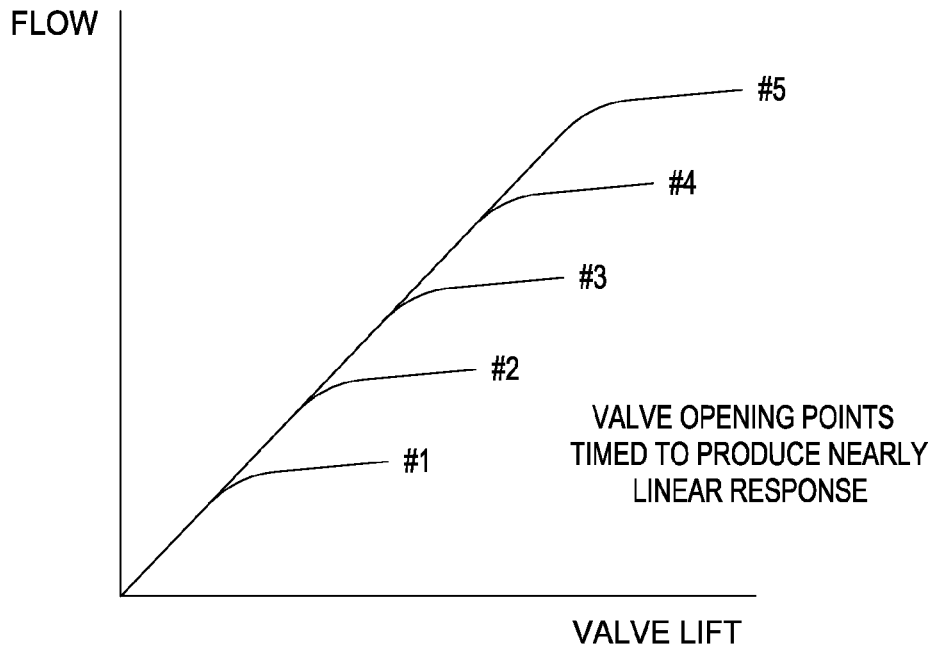
FIG. 4*a* illustrates a graph of exemplary operating conditions of a turbomachine according to one or more aspects of the present disclosure.

FIG. 4A is a graph of process gas flow rate (y-axis) versus valve lift (x-axis) representing an exemplary operation of the turbomachine 100. The control system 203 may be configured to operate the valves 120 so that valve opening points are timed to produce a nearly linear response. As shown in FIG. 4*a*, the turbomachine initially runs at the first valve operating point, on the line labeled #1. Prior to, or shortly thereafter, the gains in power in response to increased flow rate begin to become attenuated, and the control system 203 changes the sequence, for example, by opening one or more of the valves 120, thereby moving the flow rate to the next line (i.e. #2). Thus, the gains from increased flow rate can be realized similarly to an ideal system, i.e. closer to linearly. For example, the line labeled #1 may represent a first set of valves 120 that are completely open, and the line labeled #2 may represent one or more additional valves 120 that are opened while keeping the first set of valves 120 completely open.

Figure 4B:
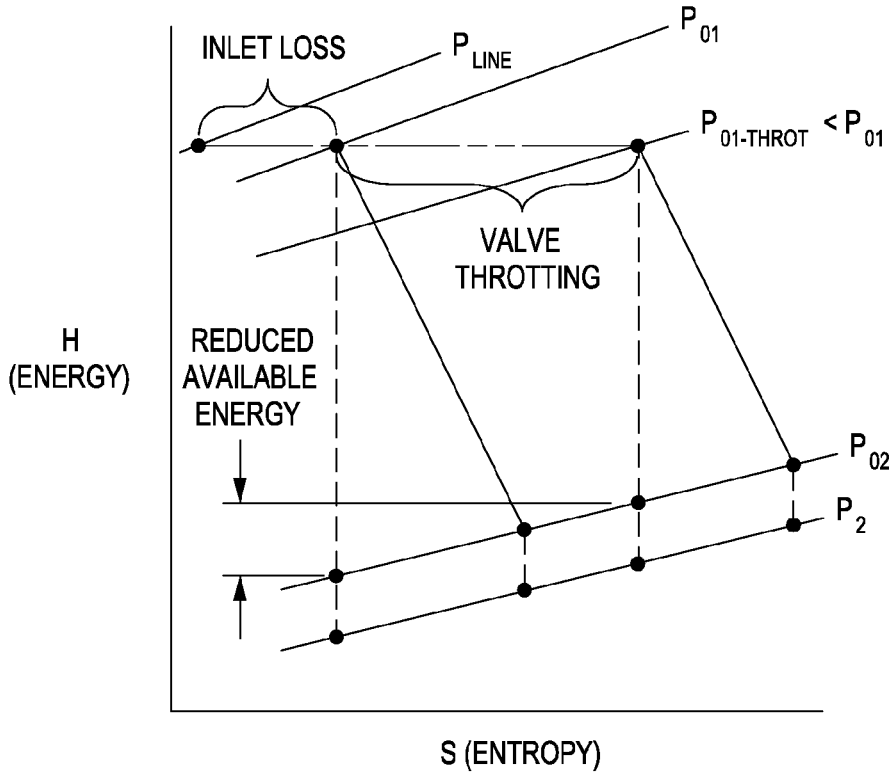
FIG. 4*b* illustrates a graph of exemplary operating conditions of a turbomachine according to one or more aspects of the present disclosure.

FIG. 4B is a graph of energy ("H" along the y-axis) versus entropy ("S" along the x-axis) representing an exemplary operation of the turbomachine 100. For a given value of H ahead of the valves 120, a fixed amount of energy H is initially provided, which corresponds to the line labeled $P_{Line}$. A small pressure drop through the open valve 120 brings the steam to line P01: a lower pressure but the same amount of energy. Expansion through the nozzles 160 results in a pressure drop to line P02 and the difference in H between lines P01 and P02 is the energy that has been converted to do useful work on the nozzles 140.

If one or more of the valves 120 are only partly open, there is a larger pressure drop through the partly open valve(s) 120, and the steam exiting the partly open valves 120 has a lower pressure P01-Throt, which is lower than P01. This pressure drop is what restricts the flow through to the partly open valve(s) 120. When the steam from the partly open valve(s) 120 is expanded to the lower pressure through the respective set of nozzles 140, it reaches the P02 line at a different location. The smaller distance between the P01-Throt and the P02 line means there is less energy available to do work. The remaining energy has been dissipated in any of several forms, including noise.

Figure 5:
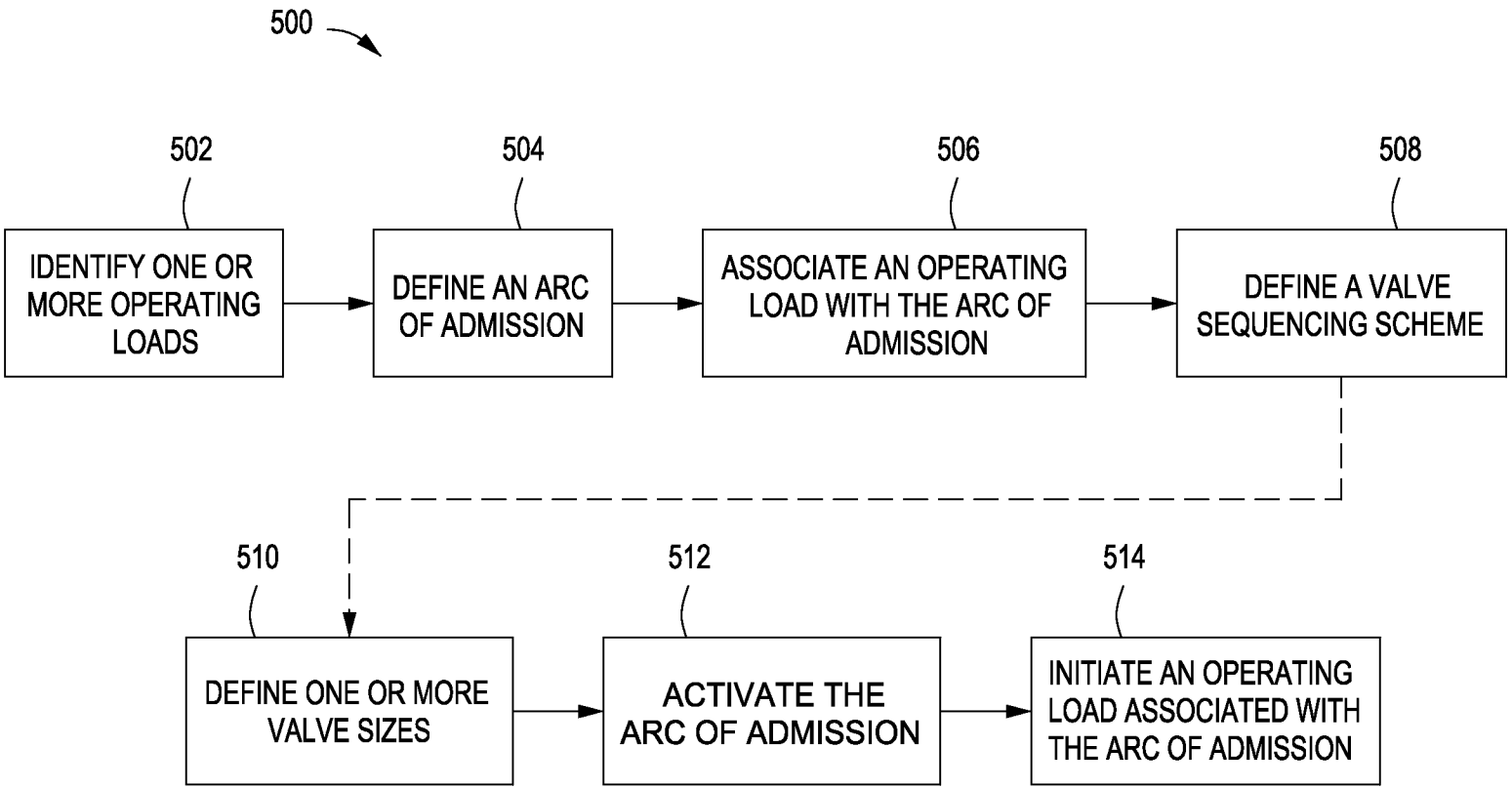
FIG. 5 illustrates a flow chart of a method for operating a turbomachine according to one or more aspects of the present disclosure.

FIG. 5 is a flow chart representing an exemplary method 500 for operating the turbomachine 100. First, an operating load for turbomachine 100 is selected. Next, the particular arc of admission, i.e., nozzle 140 selection, needed to achieve the operating load is identified. Next, the valve 120 settings required to implement the identified arc of admission are identified. Finally, the valves 120 are simultaneously adjusted to yield the selected operating load. For example, a first turbomachine 100 operating load (e.g., startup) may be associated with a first arc of admission defined by opening the valves 120*a-b*, and thereby provide process gas to the nozzle bowls 135*a-b*. Further, a second turbomachine 100 operating load (e.g., operation at a fraction of maximum power) may be associated with a second arc of admission defined by opening the valves 120*a-d*, and thereby provide process gas to the nozzle bowls 135*a-d*. Finally, a third turbomachine 100 operating load (e.g. operation at maximum power) may be associated with a third arc of admission defined by opening the valves 120, and thereby provide a process gas to all of the nozzle bowls 135*a-e*. It should be understood that any combination of operating loads and arc(s) of admission is within the scope of the present disclosure.

Thus, one or more turbomachine 100 operating loads may be defined, and an operating load may be associated with an arc of admission. Valve sequencing may be used to control the activation of certain arcs of admission in accordance with associated operating loads. An arc of admission is "activated" by opening the valves 120 that are fluidically coupled to the nozzle bowls 135*a-e* that define the arc of admission, and closing the valves 120 and the nozzle bowls 135*a-e* that are fluidically coupled to the nozzle bowls 135*a-e* that are not part of the arc of admission. Further, valve sequencing may be used to attenuate valve noise in accordance with one or more of the turbomachine 100 operating loads. For example, in an exemplary embodiment, the valves 120 may be sequenced so that the turbomachine 100 is operating at an even valve point during one or more of the turbomachine 100 operating loads. In another exemplary embodiment, the valves 120 may be sequenced to minimize the time that valves 120 spend at a throttling position.

According to an exemplary embodiment, the method 500 begins at block 502, wherein one or more of the turbomachine operating loads are identified. One or more arcs of admission are defined at block 504, such that the arcs of admission minimize valve noise produced during the associated operating load. At block 506, an operating load is associated with the arc of admission. A valve sequencing scheme is defined at block 508. Optionally, the size of one or more of the valves 120 is defined at block 510 to minimize valve noise produced during the associated operating load.

Blocks 512 and 514 include operating the turbomachine 100 in accordance with the valve sequencing scheme. Block 512 includes activating the arc of admission, and block 514 may include initiating an operating load associated with the arc of admission.

Figure 6:
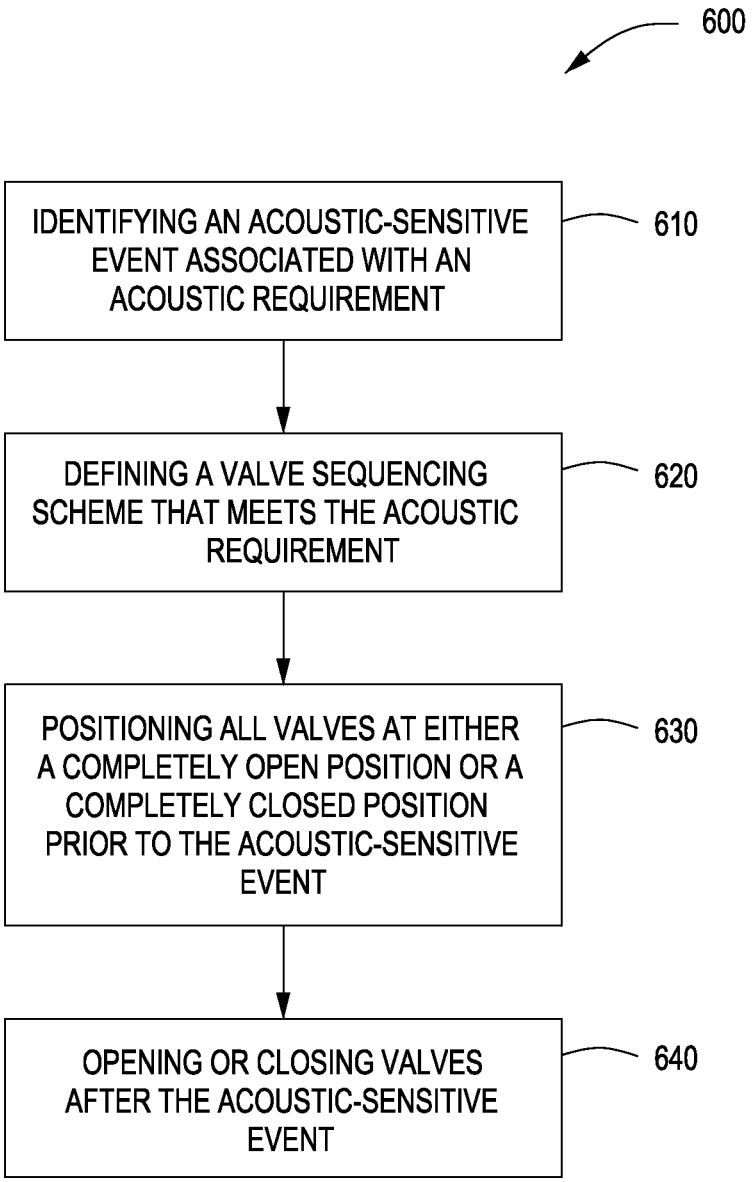
FIG. 6 illustrates a flow chart of a method for operating a turbomachine according to one or more aspects of the present disclosure.

FIG. 6 is a flow chart representing another exemplary method 600 for operating the turbomachine 100. According to an exemplary embodiment, the method 600 begins at block 610, which includes identifying an acoustic-sensitive event associated with an acoustic requirement. Block 620 includes defining a valve sequencing scheme that meets the acoustic requirement. The valve sequencing scheme meets the acoustic requirement when the acoustic signature of the turbomachine 100 satisfies the acoustic requirement. Block 630 includes positioning all valves 120 at either a completely open position or a completely closed position prior to the acoustic-sensitive event. Finally, block 640 includes opening or closing one or more of the valves 120 after the acoustic-sensitive event.

According to an exemplary embodiment, an acoustic-sensitive event is an event that is scheduled to occur during operation of the turbomachine 100. For example, events such as start-up, reduced power, or maximum power, may be acoustic-sensitive events. Valve noise may be undesirable during such acoustic-sensitive events. Upon identifying one or more acoustic-sensitive events, a valve sequencing scheme may be implemented to attenuate the production of noise while the turbomachine is operating at an operating load associated with, or required by, the turbomachine during the acoustic-sensitive event.

In an exemplary embodiment, a valve sequencing scheme is implemented by defining the timing of valve 120 openings and closings so that an acoustic-sensitive event occurs before the next valve 120 in a sequence begins to open, and the valves 120 are configured to be at an even valve point during the acoustic-sensitive event. In some exemplary embodiments, a valve sequencing scheme designed to accommodate one or more acoustic-sensitive events may sacrifice turbine operation efficiency in order to obtain a desired acoustical target result.

An acoustic-sensitive event may include one or more transition events. A transition event includes an event where a first operating load transitions to a second operating load. During such transition events, valve noise may be undesirable. Upon identifying one or more transition events, a valve sequencing scheme is implemented to attenuate turbomachine 100 noise. In an exemplary embodiment, a valve sequencing system is configured to time the opening and closing of the valves 120 so that one or more transition events occur before the next valve 120 in a sequence begins to open. In some exemplary embodiments, a valve sequencing scheme designed to accommodate one or more transition events may sacrifice turbine operation efficiency in order to obtain a desired acoustical target result.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A method for operating a turbomachine having steam admitting valves, comprising:

actuating all steam admitting valves to form a first arc of admission corresponding to a first load, wherein the first arc of admission corresponds to a first specific position of each of the steam admitting valves;

operating the turbomachine at the first load with a process gas at a first flow rate, wherein the first flow rate of the process gas corresponds to operating parameters of the first load; and transitioning the turbomachine to a second load corresponding to a second arc of admission, wherein the second arc admission corresponds to a second specific position of each of the steam admitting valves, wherein:

transitioning to the second load corresponding to the second arc of admission adjusts the first flow rate of the process gas to correspond to a second flow rate of the process gas, wherein the second flow rate of the process gas corresponds to operating parameters of the second load, and transitioning the turbomachine to the second load comprises adjusting a timing of a valve sequencing scheme to reduce an operating efficiency of the turbomachine relative to an operating efficiency of the turbomachine before the transition and to obtain a reduced acoustic signature of the turbomachine that is less than an acoustic signature of the turbomachine before the transition;

wherein each of the steam admitting valves are positioned at a completely open position or a completely closed position when the turbomachine is operating at the first arc of admission and the second arc of admission.

2. The method of claim 1, wherein:

actuating each of the steam admitting valves to the completely open position or the completely closed position corresponding to the first load comprises minimizing an amount of time that each of the steam admitting valves are at a throttling position; and actuating each of the steam admitting valves to the completely open position or the completely closed position corresponding to the second load comprises minimizing the amount of time that each of the steam admitting valves are at the throttling position.

3. The method of claim 1, wherein the first load corresponding to the first arc of admission or the second load corresponding to the second arc of admission is an even valve point arc of admission reducing an acoustic signature of the valves.

4. The method of claim 1, wherein transitioning the turbomachine to the second load comprises increasing the first flow rate of the process gas through the valves.

5. The method of claim 1, further comprising actuating each of the valves with an individual valve actuator, each individual valve actuator configured to be controlled by a control system.

6. A method for operating a turbomachine having a plurality of steam admitting valves, comprising:

operating the turbomachine at a first mode of operation corresponding to a first arc of admission and a first flow rate of a process gas, wherein the first arc of admission corresponds to a first specific position of each of the plurality of steam admitting valves;

transitioning the turbomachine from the first mode of operation corresponding to the first arc of admission to a second mode of operation corresponding to a second arc of admission, wherein the second arc of admission corresponds to a second specific position of each of the plurality of steam admitting valves, wherein:

transitioning to the second mode of operation corresponding to the second arc of admission adjusts the first flow rate of the process gas to correspond to a second flow rate of the process gas, wherein the second flow rate of the process gas corresponds to operating parameters of the second mode of operation, and transitioning the turbomachine from the first mode of operation to the second mode of operation comprises adjusting a timing of a valve sequencing scheme to reduce an operating efficiency of the turbomachine relative to an operating efficiency of the turbomachine before the transition and to obtain a reduced acoustic signature of the turbomachine that is less than an acoustic signature of the turbomachine before the transition, wherein each of the plurality of steam admitting valves are positioned at a completely open position or a completely closed position when the turbomachine is operating at the first arc of admission and the second arc of admission; and operating the turbomachine in the second mode of operation with the process gas at the second flow rate.

7. The method of claim 6, wherein transitioning the turbomachine from the first mode of operation to the second mode of operation further comprises increasing a flow rate of the turbomachine from the first flow rate corresponding to the first mode of operation to the second flow rate corresponding to the second mode of operation.

8. The method of claim 7, wherein transitioning the turbomachine from the first mode of operation to the second mode of operation further comprises minimizing an amount of time that the plurality of steam admitting valves are at a throttling position.

9. A method for operating a turbomachine having a plurality of steam admitting valves, comprising:

operating the turbomachine at a first load corresponding to a first arc of admission with a process gas at a first flow rate, wherein the first arc of admission corresponds to a first specific position of each of the plurality of steam admitting valves;

transitioning the turbomachine to a second load corresponding to a second arc of admission, wherein the second arc of admission corresponds to a second specific position of each of the plurality of steam admitting valves, wherein:

transitioning the turbomachine to the second load corresponding to the second arc of admission adjusts the first flow rate of the process gas to correspond to a second flow rate of the process gas, wherein the second flow rate corresponds to operating parameters of the second load, and transitioning the turbomachine to the second load comprises adjusting a timing of a valve sequencing scheme to reduce an operating efficiency of the turbomachine relative to an operating efficiency of the turbomachine before the transition and to obtain a reduced acoustic signature of the turbomachine that is less than an acoustic signature of the turbomachine before the transition, wherein each of the plurality of steam admitting valves are positioned at a completely open position or a completely closed position in each of the first arc of admission and the second arc of admission;

actuating more than two valves of the plurality of steam admitting valves according to the valve sequencing scheme after transitioning the turbomachine to the second load, wherein the valve sequencing scheme includes opening a first steam admitting valve and a second steam admitting valve simultaneously; and operating the turbomachine at the second load with the process gas at the second flow rate.

10. The method of claim 9, further comprising:

actuating each valve of the plurality of steam admitting valves with an individual valve actuator; and controlling each individual valve actuator with a control system.

11. The method of claim 1, further comprising disposing resonator arrays proximal a diaphragm of the turbomachine.

12. The method of claim 6, further comprising disposing resonator arrays proximal a diaphragm of the turbomachine.

13. The method of claim 9, further comprising disposing resonator arrays proximal a diaphragm of the turbomachine.

* * * * *